US009383168B2

(12) United States Patent
Stokes et al.

(10) Patent No.: US 9,383,168 B2
(45) Date of Patent: Jul. 5, 2016

(54) OPTICAL SUPER-ELEVATION DEVICE

(75) Inventors: Robert M. Stokes, The Colony, TX (US); William M. Bowser, Plano, TX (US); Clint E. Bolen, Frisco, TX (US); Jerry L. Stiller, Wylie, TX (US)

(73) Assignee: RAYTHEON COMPANY, Waltham, MA (US)

( * ) Notice: Subject to any disclaimer, the term of this patent is extended or adjusted under 35 U.S.C. 154(b) by 0 days.

(21) Appl. No.: 14/391,629

(22) PCT Filed: May 21, 2012

(86) PCT No.: PCT/US2012/038748

§ 371 (c)(1),
(2), (4) Date: Oct. 9, 2014

(87) PCT Pub. No.: WO2013/176644

PCT Pub. Date: Nov. 28, 2013

(65) Prior Publication Data

US 2015/0068098 A1 Mar. 12, 2015

(51) Int. Cl.

| | |
|---|---|
| ***G06G 7/80*** | (2006.01) |
| ***F41G 1/46*** | (2006.01) |
| ***F41G 1/40*** | (2006.01) |
| ***F41G 3/06*** | (2006.01) |
| ***F41G 1/48*** | (2006.01) |
| ***F41G 1/41*** | (2006.01) |

(52) U.S. Cl.

CPC .. *F41G 1/46* (2013.01); *F41G 1/40* (2013.01); *F41G 1/41* (2013.01); *F41G 1/48* (2013.01); *F41G 3/06* (2013.01)

(58) Field of Classification Search

USPC ..... 235/404, 407; 359/402, 405, 406

See application file for complete search history.

(56) References Cited

U.S. PATENT DOCUMENTS

| | | | | |
|---|---|---|---|---|
| 2,412,298 | A | 12/1946 | Siazik | |
| 4,978,206 | A * | 12/1990 | Neuman | G02B 23/08 359/405 |
| 5,060,554 | A * | 10/1991 | Aharon | F41H 5/266 359/402 |
| 5,171,933 | A | 12/1992 | Eldering | |
| 5,456,157 | A | 10/1995 | Lougheed et al. | |
| 5,686,690 | A | 11/1997 | Lougheed et al. | |
| 6,499,382 | B1 | 12/2002 | Lougheed et al. | |
| 2003/0128425 | A1 * | 7/2003 | Granberg | G02B 23/08 359/406 |
| 2006/0272194 | A1 | 12/2006 | Guettner | |
| 2011/0030545 | A1 | 2/2011 | Klein | |

FOREIGN PATENT DOCUMENTS

GB 2309770 A 8/1997

* cited by examiner

*Primary Examiner* — Daniel Hess
(74) *Attorney, Agent, or Firm* — Lando & Anastasi, LLP

(57) ABSTRACT

An optical super-elevation device including an elevation follower mirror that counter-rotates with an opposite angular rate to the weapon elevation rate, thereby maintaining the line of sight to the target during the elevation process. In one example, the optical super-elevation device includes a modular housing having a mounting bracket configured to fixedly mount to at a weapon or azimuth axis of a tripod, an elevation follower mirror rotatably mounted within the housing, and a mirror actuator coupled to the elevation follower mirror and configured to counter-rotate the elevation follower mirror at an angular rate opposite to an elevation rate of the weapon to maintain a line of sight to a target during super-elevation of the weapon.

15 Claims, 12 Drawing Sheets

OPTICAL SUPER-ELEVATION DEVICE

BACKGROUND

So-called "crew-served" weapons are operated by one or two persons and generally include "light" machine guns, which fire non-explosive rounds, and "heavy" machine guns which fire larger rounds or grenades. For some weapons, such as grenade-launching machine guns, which fire relatively slow, heavy rounds, it is necessary to elevate the barrel relative to the sight line to the target for ballistics compensation at longer ranges. This relative upward tilt is known as "super-elevation" or "SEL." The SEL tilt angle is variable depending on the range to the target and the size/weight of the rounds being fired, and may be relatively large, for example, up to about 30 degrees.

Conventional super-elevation devices operate based on mechanical adjustments between the weapon axis and the sighting device, setting the SEL angle prior to viewing and engaging the target. For example, referring to FIG. 1, the sighting device 110 may be mounted to the machine gun barrel 120 on an adjustable bracket 130. An operator estimates the range to a target, sets the bracket 130, for example, by adjusting the location of a set-pin 132 on bracket rails 134, to achieve a desired SEL angle 140, and then elevates the weapon. This mechanism has the disadvantage that the operator must then re-acquire the target using the sighting device 110 after the SEL angle 140 has been set.

U.S. Pat. No. 6,499,382 describes an electro-mechanical super-elevation device in which the sighting device can be disengaged from the weapon barrel and locked in position, such that the weapon may be elevated without moving the sighting device and thereby allowing the operator to continue to view the target through the sighting device during the super-elevation procedure.

SUMMARY OF INVENTION

Conventional super-elevation devices suffer from several disadvantages. For example, as discussed above, with most conventional mechanical super-elevation devices the operator cannot maintain the target in sight during the elevation procedure. While this problem may be addressed by some electro-mechanical solutions, such as that described in U.S. Pat. No. 6,499,382, these devices are large, heavy, often expensive and complex, and may have significant power requirements.

Aspects and embodiments are directed to an optical super-elevation device which may allow an operator to keep eyes on target throughout engagement while also having significantly reduced size, weight and power characteristics. As discussed in more detail below, in one embodiment, the optical super-elevation device uses an elevation follower mirror, together with an actuator (for example, a relatively small motor), that counter-rotates with an opposite angular rate to the weapon elevation rate, thereby maintaining the line of sight to the target during the elevation process. Since only the low-mass elevation follower mirror may be moved to steer the line of sight, the power used to maintain the super elevation rate and range of motion performance may be very low compared to conventional devices.

According to one embodiment, an optical super-elevation device comprises a modular housing including a first mounting bracket configured to fixedly mount to at least one of a weapon and an azimuth axis of a tripod configured to support the weapon, an elevation follower mirror rotatably mounted within the housing, and a mirror actuator coupled to the elevation follower mirror and configured to counter-rotate the elevation follower mirror at an angular rate opposite to an elevation rate of the weapon to maintain a line of sight to a target during super-elevation of the weapon.

In one example, the optical super-elevation device further comprises a position sensor that provides mirror position information and weapon position information, and a controller coupled to the position sensor and to the mirror actuator, the controller configured to receive the mirror position information and the weapon position information from the position sensor and to control the mirror actuator to control the angular rate of the elevation follower mirror based on the mirror position information and the weapon position information. The position sensor may include, for example, a mirror angle resolver coupled to the elevation follower mirror and configured to provide the mirror position information, the mirror position information including an angular position of the elevation follower mirror, a motion sensor coupled to the weapon and configured to provide the weapon position and angle position rate information, and an azimuth position sensor coupled to the weapon and configured to provide weapon azimuth position information. In one example, the weapon position information includes weapon cant and elevation information, and wherein the controller is configured to determine the weapon elevation rate based on the weapon cant and elevation information.

The optical super-elevation device may further comprise a front window disposed within the housing, and a rear window disposed within the housing, wherein the elevation follower mirror is arranged within the housing such that the line of sight to the target sequentially passes through the rear window, is deflected by the elevation follower mirror, and passes through the front window. In one example the optical super-elevation device further comprises a fold mirror disposed within the housing and positioned in the line-of-sight to the target between the rear window and the elevation follower mirror. In another example the optical super-elevation device further comprises a second mounting bracket coupled to the housing and configured to receive and mount a weapon sighting unit behind the rear window and to receive and mount a laser range finding unit. The front and rear windows may be multi-spectral windows configured to pass at least one of infrared electromagnetic radiation and visible light.

The optical super-elevation device may further comprise a battery pack coupled to the housing and configured to provide all operating power to the mirror actuator.

Another embodiment is directed to a weapon sighting system configured to be mounted to a weapon and comprising a weapon sighting unit, and an optical super-elevation device including an elevation follower mirror rotatably mounted within a housing, and a mirror actuator coupled to the elevation follower mirror and configured to counter-rotate the elevation follower mirror, wherein the weapon sighting unit is mounted to the optical super-elevation device such that a line-of-sight of the weapon sighting unit to a target passes through the optical super-elevation device and is steered by the elevation follower mirror.

In one example, the weapon sighting unit includes at least one of a thermal imaging system, a visible imaging sensor and an infrared imaging sensor. The weapon sighting system may further comprise a laser range-finder coupled to the weapon sighting unit. In one example the laser range-finder is mounted such that a line-of-sight from the laser range-finder to the target passes through the optical super-elevation device. In another example, the laser range-finder is mounted such that a line-of-sight from the laser range-finder to the target does not pass through the optical super-elevation device.

The weapon sighting system may further comprise a position sensor coupled to the elevation follower mirror, and a controller coupled to the mirror actuator and to the position sensor and configured to control an angular rate of counter-rotation of the elevation follower mirror based on information received from the position sensor. In one example the position sensor includes a mirror angle resolver coupled to the elevation follower mirror and configured to provide mirror position information, the mirror position information including an angular position of the elevation follower mirror, and a motion sensor coupled to the weapon and configured to weapon cant and elevation position information, wherein the controller is configured to control the angular rate of counter-rotation the elevation follower mirror based on the mirror position information and the weapon cant and elevation information to counter-rotate the elevation follower mirror at the angular rate opposite to an elevation rate of the weapon.

Still other aspects, embodiments, and advantages of these exemplary aspects and embodiments are discussed in detail below. Embodiments disclosed herein may be combined with other embodiments in any manner consistent with at least one of the principles disclosed herein, and references to "an embodiment," "some embodiments," "an alternate embodiment," "various embodiments," "one embodiment" or the like are not necessarily mutually exclusive and are intended to indicate that a particular feature, structure, or characteristic described may be included in at least one embodiment. The appearances of such terms herein are not necessarily all referring to the same embodiment.

BRIEF DESCRIPTION OF THE DRAWINGS

Various aspects of at least one embodiment are discussed below with reference to the accompanying figures, which are not intended to be drawn to scale. The figures are included to provide illustration and a further understanding of the various aspects and embodiments, and are incorporated in and constitute a part of this specification, but are not intended as a definition of the limits of the invention. In the figures, each identical or nearly identical component that is illustrated in various figures is represented by a like numeral. For purposes of clarity, not every component may be labeled in every figure. In the figures.

DETAILED DESCRIPTION

Aspects and embodiments are directed to an optical super-elevation device that may provide for accurate steering of a weapon sight line-of-sight to a target for range ballistics compensation during engagements. The optical super-elevation device may be used with a weapon sight, as discussed further below, to provide a continuous "eyes-on-target" fire control solution while the operator is elevating the weapon to engage targets. Embodiments of the optical super-elevation device are compatible with laser range-finder systems and thermal weapon sighting systems, as discussed in more detail below. According to various embodiments, the optical super-elevation device includes a movable reflective head mirror in combination with a fixed fold mirror to steer the optical line of sight, viewed through the weapon sighting system, for example, while the weapon is elevated during target engagement. In one example, an embedded closed-loop electronic controller is used to counter-rotate the head mirror with an opposite angular rate to the weapon elevation rate, thereby maintaining the line of sight to the target. The optical super-elevation device may be battery-powered, environmentally sealed, and may be configured such that the weapon sight accuracy is not disturbed by the super-elevation device, as discussed further below.

It is to be appreciated that embodiments of the methods and apparatuses discussed herein are not limited in application to the details of construction and the arrangement of components set forth in the following description or illustrated in the accompanying drawings. The methods and apparatuses are capable of implementation in other embodiments and of being practiced or of being carried out in various ways. Examples of specific implementations are provided herein for illustrative purposes only and are not intended to be limiting. In particular, acts, elements and features discussed in connection with any one or more embodiments are not intended to be excluded from a similar role in any other embodiment. Also, the phraseology and terminology used herein is for the purpose of description and should not be regarded as limiting. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms.

Figure 1:
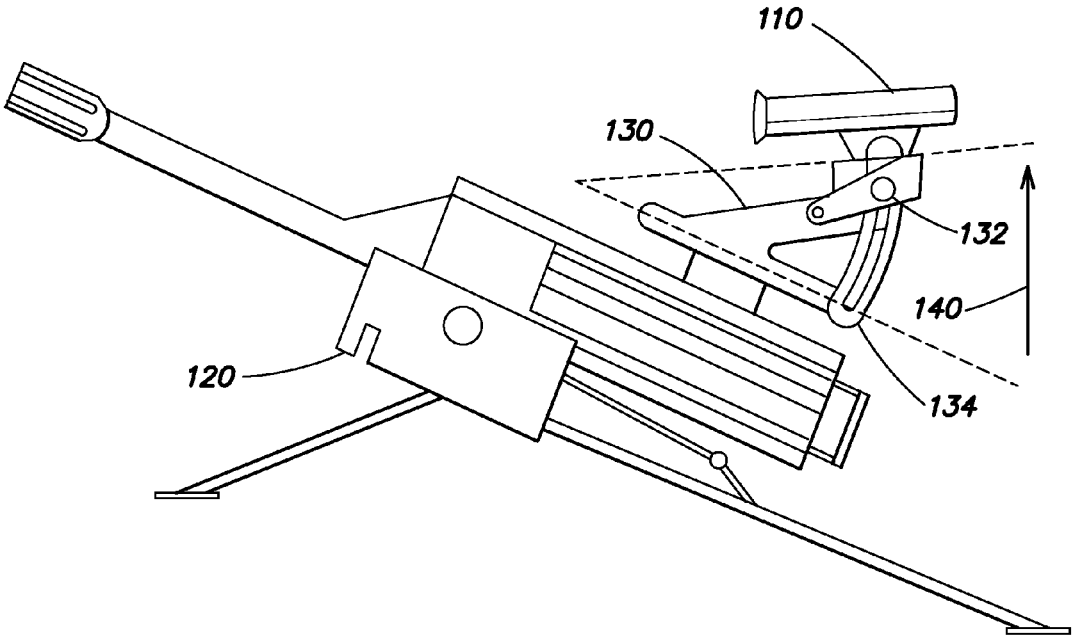
FIG. 1 (Related Art)
FIG. 1 is a diagram of one example of a machine gun illustrating a conventional mechanical super-elevation device.
Figure 2:
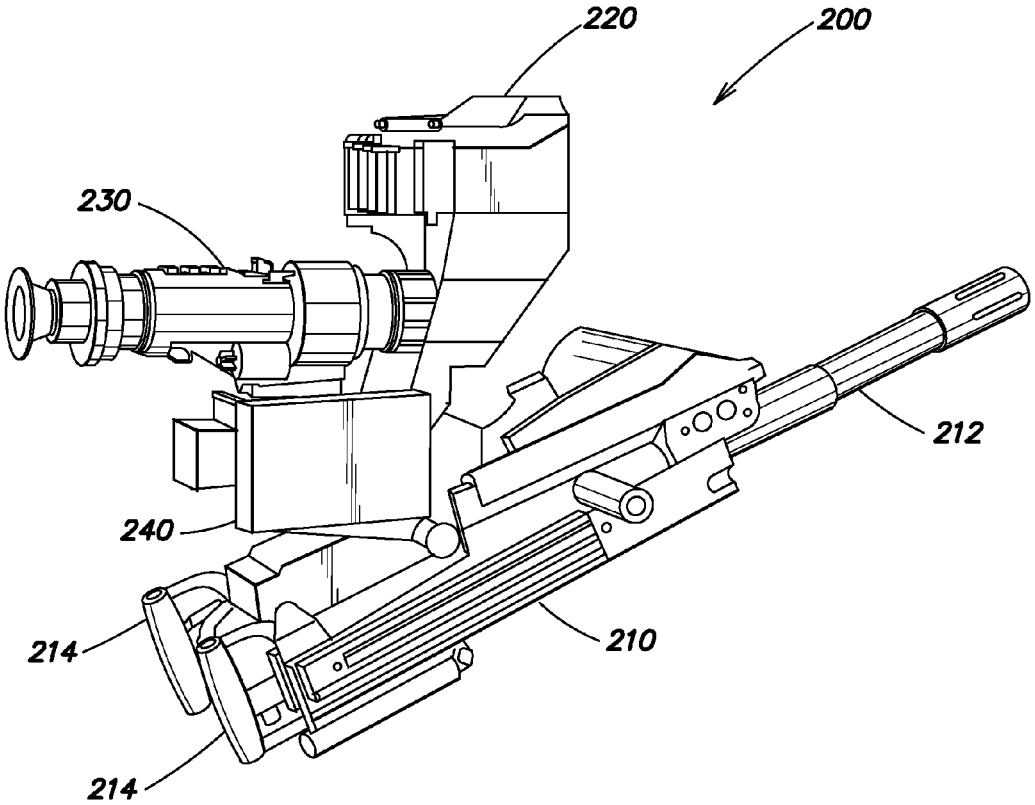
FIG. 2 is a diagram of one example of an optical super-elevation device mounted to a machine gun, according to aspects of the invention.

Referring to FIG. 2, there is illustrated an example of a weapon system in which embodiments of the optical super-elevation device may be used. In one example, the weapon system 200 is a crew-served machine gun, such as a grenade machine gun, including a weapon body 210 having a barrel 212. Although not shown in FIG. 2, the weapon body 210 may be mounted in a cradle mount and optionally attached to a tripod, as illustrated in FIG. 1, to allow the weapon system 100 to be pivoted in azimuth and elevation relative to the mount. Handles 214 at the rear end of the weapon body 210 allow the operator to pivot the weapon in azimuth and elevation. Alternatively, the weapon system 100 may be hand-held. In one embodiment, the optical super-elevation device 220 is fixedly mounted to the weapon body 210. A sighting unit 230, such as a thermal weapon sighting unit, for example, is also mounted to the weapon body 210, optionally along with other devices, such as a laser range-finder 240, as discussed further below. In one embodiment, the sighting unit 230 is mounted behind the optical super-elevation device 220 such that the operator's line-of-sight to the target is through both the optical super-elevation device 220 and the sighting unit 230.

Figure 3:
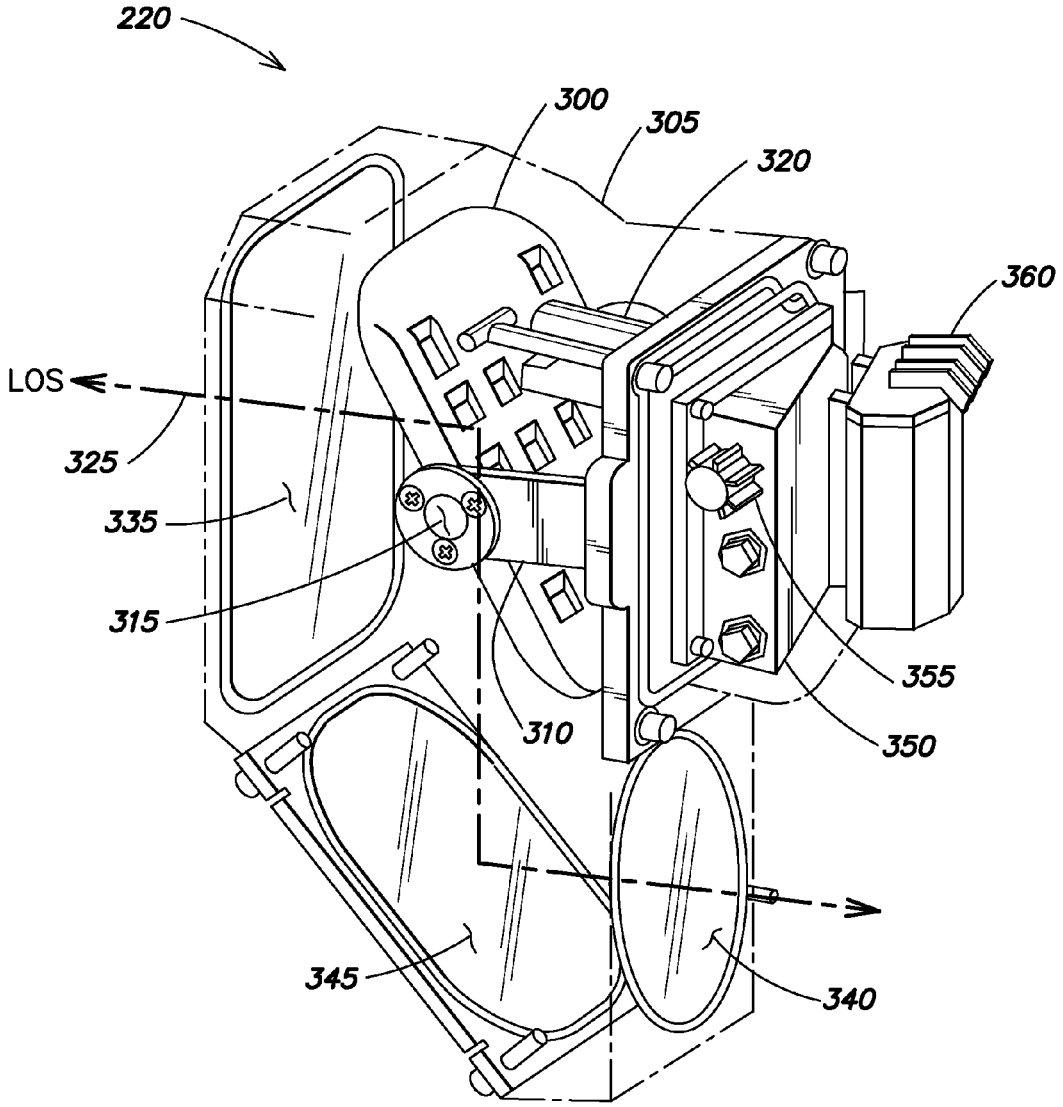
FIG. 3 is a perspective view of one example of an optical super-elevation device according to aspects of the invention.
Figure 4:
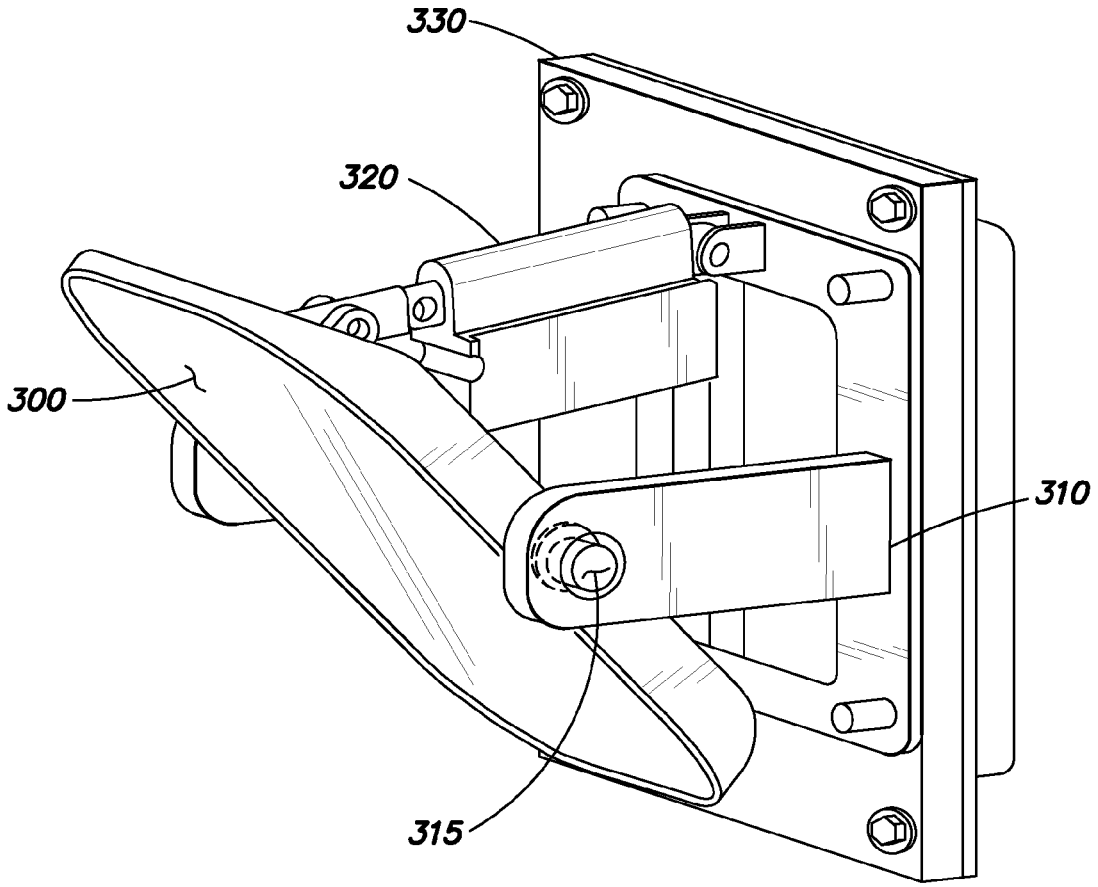
FIG. 4 is a diagram illustrating an example of a mounting structure for an elevation follower mirror in an optical super-elevation device according to aspects of the invention.

As discussed above, the optical super-elevation device 220 is configured to allow the operator to continuously keep eyes on the target during an engagement. To perform this function the optical super-elevation device 220 includes an elevation follower mirror that counter-rotates to the weapon elevation in order for the sight assembly to maintain its line of sight (LOS) to the target. An example of a modular optical super-elevation device 220 including a pivoting elevation follower mirror 300 is illustrated in FIG. 3. In one example, the elevation follower mirror 300 is a unity magnification or zero-power mirror. The elevation follower mirror 300 may be polished aluminum mirror, for example. Referring to FIG. 3, in one embodiment, the follower mirror 300 is mounted within a housing 305 of the device 220 via a mounting arm 310. The follower mirror 300 includes a pin 315 that is able to rotate within the mounting arm 310, to allow the follower mirror 300 to be tilted by a mirror actuator 320. FIG. 4 illustrates an example of the mounting structure of the elevation follower mirror 300. In the illustrated example, the mounting arm 310 extends from a mounting plate 330, and includes an opening to accommodate the pin 315 of the mirror 300. In this example, the mirror actuator 320 is a linear actuator, and forward-and-back motion of the actuator allows the pin 315 to rotate within the opening of the mounting arm, thereby changing the tilt angle of the follower mirror 300. In FIG. 4, the follower mirror 300 is shown positioned at a 45 degree tilt angle. In one example, the elevation follower mirror 300 has a 40 degree elevation range of motion, and the mirror actuator 320 may be configured to allow the mirror to reach maximum elevation deflection in less than one second.

According to one embodiment, movement of the follower mirror 300 optically steers the line of sight 325 of the assembly, while the optical super-elevation device 220 and the sighting unit 230 are rigidly mounted to the gun elevation axis, as illustrated in FIG. 2 and discussed further below. In one example, the elevation follower mirror 300 counter-rotates with the weapon pitch motion to allow the line-of-sight to a target to remain nearly stationary within an image of the scene containing the target (e.g., as viewed through the weapon sight system or displayed to the user on a display). Since only the low-mass follower mirror 300 may be moved to steer the line of sight 325, the power used to maintain the super elevation rate and range of motion performance may be very low, about 2.8 watts in one example, compared to an electro-mechanical pan/tilt mechanism, which may consume 10-50 watts of power. Accordingly, the optical super-elevation device may be powered using a small battery pack, which may be an advantage over conventional devices that require large power sources.

Still referring to FIG. 3, in one embodiment, the optical super-elevation device 220 includes a front window 335 and a rear window 340. The front and rear windows 335, 340 may be multi-spectral windows. For example, the front and rear windows 335, 340 may be selected to pass electromagnetic radiation within a wavelength range (or waveband) of interest, for example, visible light and/or infrared radiation. To achieve a compact housing 305, a fold mirror 345 may be used to direct the line of sight 325 from the elevation follower mirror 300 through the rear window 340, and vice versa. The fold mirror 345 may also be a unity magnification or zero-power mirror. In one example, the housing 305 has a height of about 9 inches, a width of about 6 inches, and a depth of about 7 inches. The optical super-elevation device 220 further includes a electronics module (also referred to as a controller) 350 which may control actuation of the mirror actuator 320 to steer the line of sight 305, as well as other functions as discussed further below. A control switch 355 may be used to allow an operator to switch the device on and off and optionally select different functions, as also discussed further below. The optical super-elevation device 220 also includes a power supply 360. In one example, the power supply 360 is a battery pack, for example, configured to operate using one or more AA or other commercially available batteries.

Figure 5A:
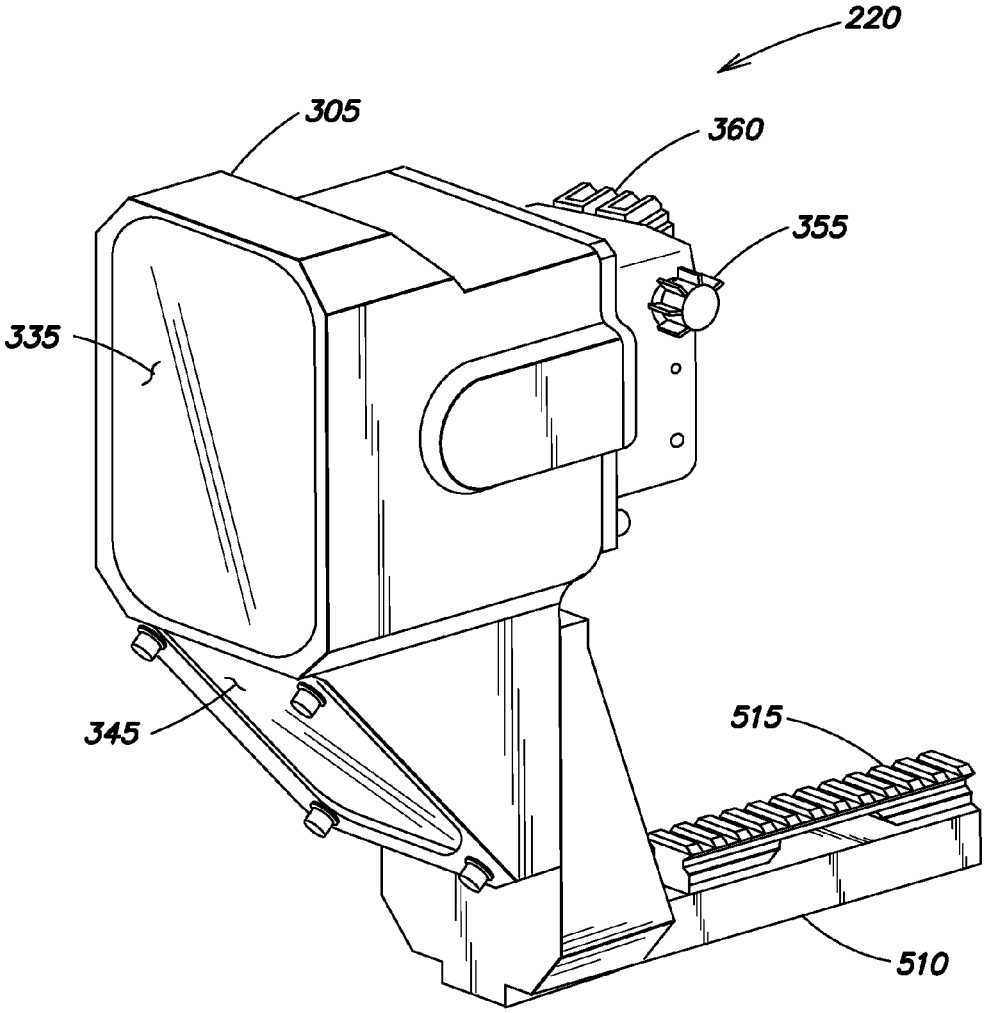
FIG. 5A is a side isometric view of one example of an optical super-elevation device according to aspects of the invention.
Figure 5B:
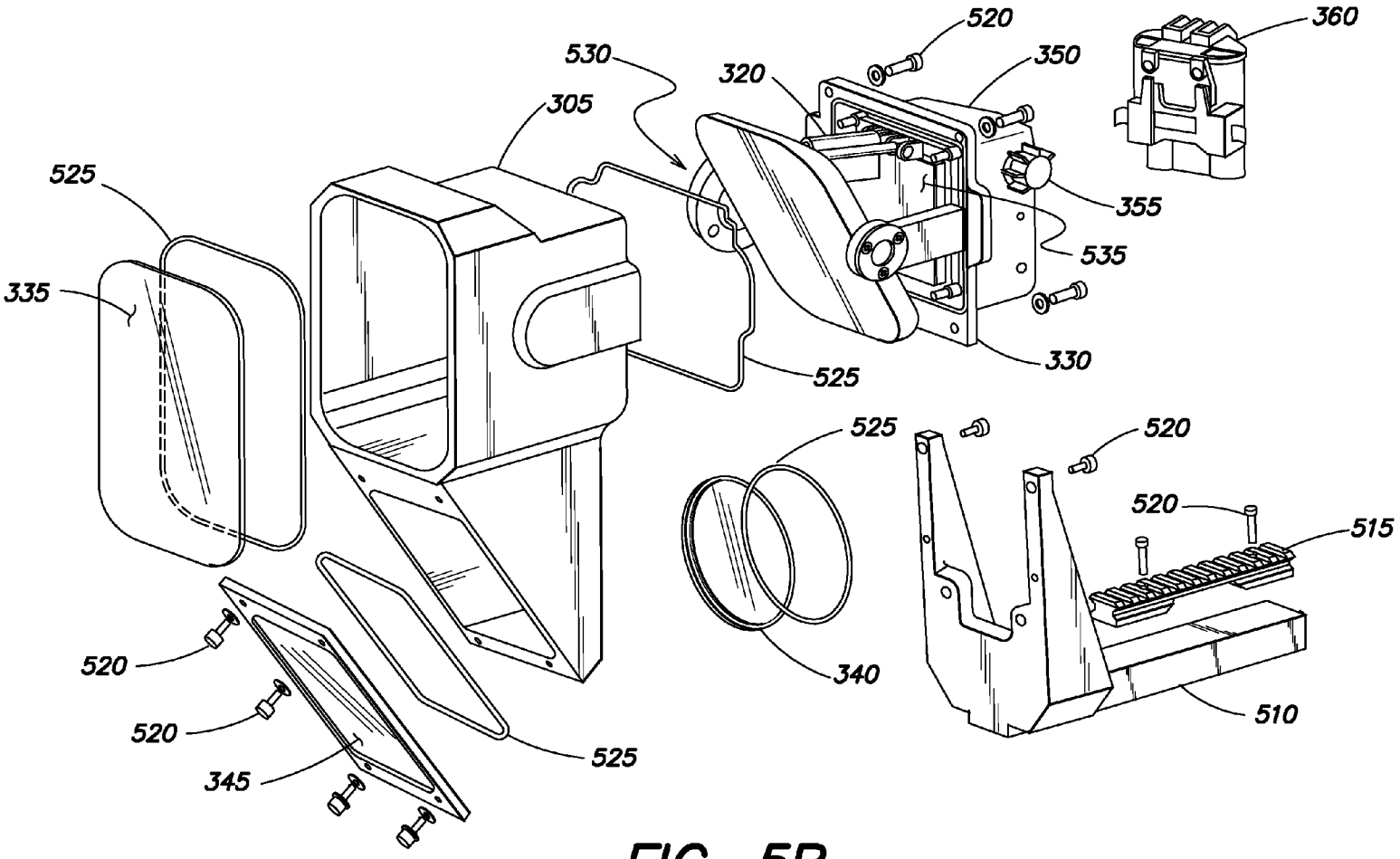
FIG. 5B is a partially exploded view of the optical super-elevation device of FIG. 5A.

FIG. 5A illustrates a side isometric view of one example of the optical super-elevation device 220, and FIG. 5B is partially exploded view of the optical super-elevation device of FIG. 5A. As discussed above, the optical super-elevation device 220 may be mounted to a weapon system, such as the machine gun body 210 of FIG. 2, using a mounting bracket 510. The mounting bracket 510 may include a rail assembly 515 for mounting the sighting unit 230, as discussed above and further below. Fasteners 520 may be used to secure the various mechanical components together. In some embodiments, gaskets or seals 525 may be used between various components, as illustrated in FIG. 5B, to provide environmental or electro-magnetic interference (EMI) sealing. According to one embodiment, the optical super-elevation device 220 further includes a mirror angle resolver 530 that detects a movement of the elevation follower mirror 300 and may be coupled to the controller 350 and used to control the tilt of the elevation follower mirror 300 to a precise angle, as discussed further below. The optical super-elevation device 220 may further include a weapon motion sensor 535 that may also provide data to the controller 350, as discussed further below. In one example, the motion sensor 535 is a two-axis motion sensor that detects motion of the weapon 200 to which the optical super-elevation device 220 is mounted. In another example, the motion sensor 535 is a north finding module sensor that detects north while also providing two- or three-axis motion sensing.

Figure 6A:
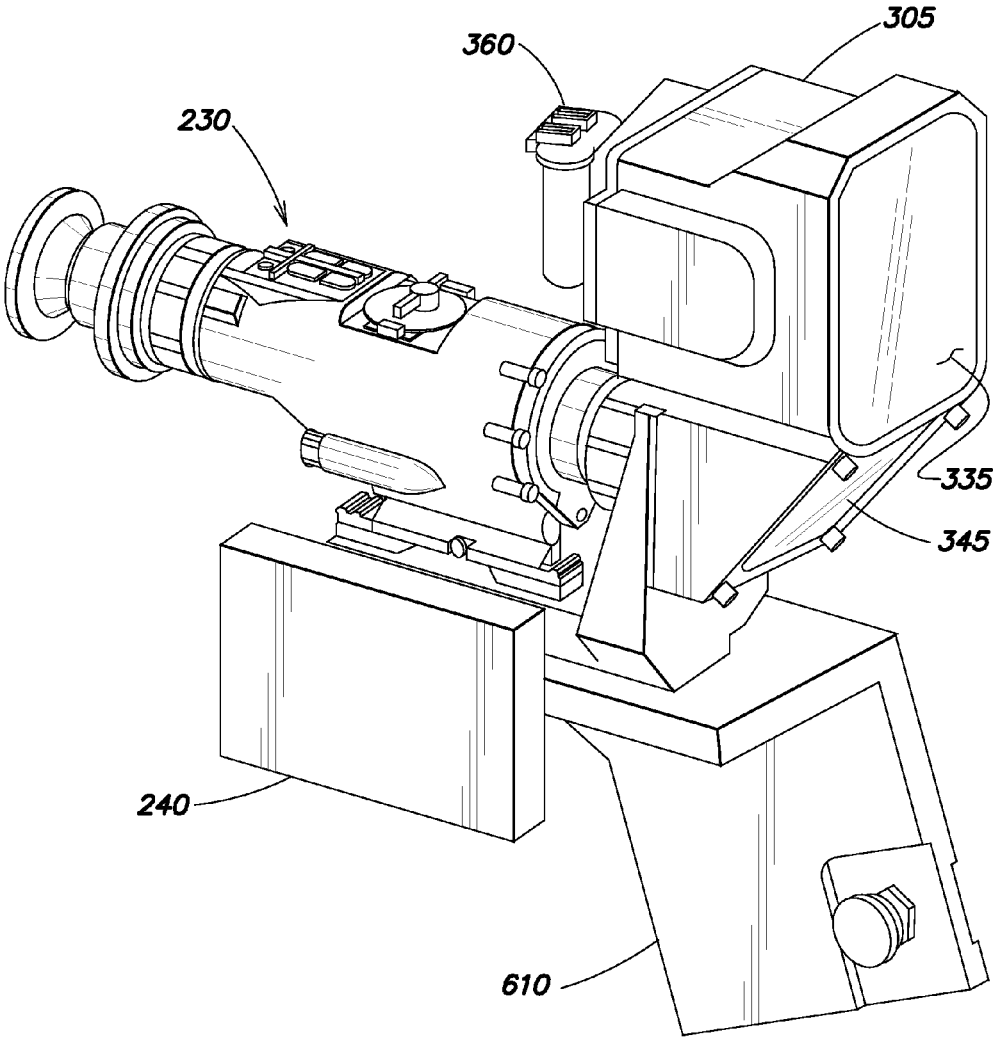
FIG. 6A is another isometric side view of the optical super-elevation device of FIG. 5A.
Figure 6B:
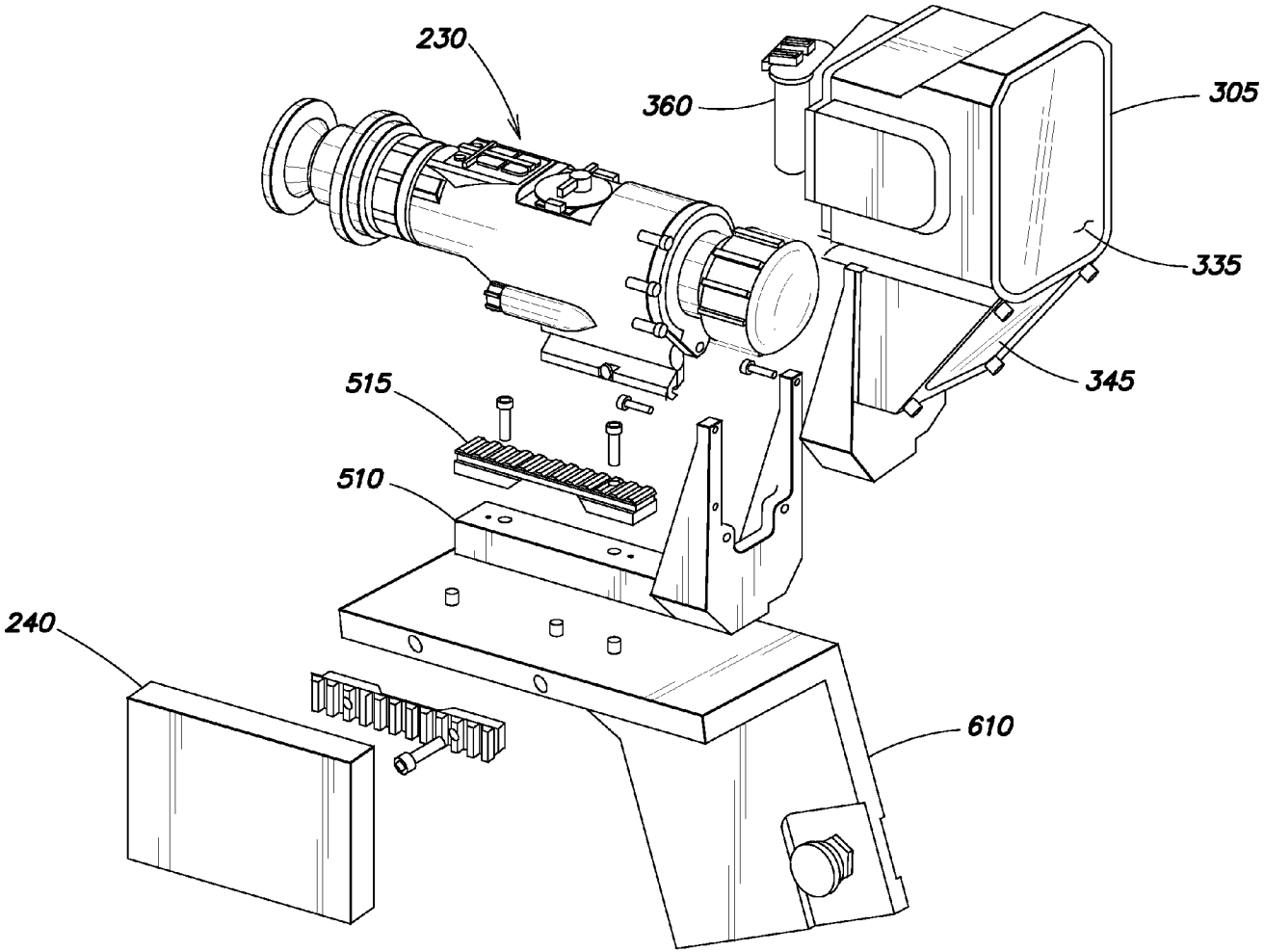
FIG. 6B is a partially exploded view of the optical super-elevation device of FIG. 6A.

Referring to FIG. 6A and FIG. 6B, there is illustrated another example of the optical super-elevation device 220, also showing the sighting unit 230 mounted in front of the optical super-elevation device. As discussed above, the optical super-elevation device 220 may include a mounting bracket 510 and rail assembly 515 for mounting the sighting unit 230. The sighting unit 230 is mounted such that a line-of-sight through the sighting unit also passes through optical super-elevation device 220, as discussed above. With this configuration, an operator may maintain a target in sight (through the sighting unit 230) while operating optical super-elevation device 220 to correctly elevate the weapon 200. The optical super-elevation device 220 may be mounted to the weapon using a bracket 610. As discussed above, in some embodiments, other devices, such as a laser range-finder unit 240, may also be mounted to the optical super-elevation device 220, as shown in FIG. 6A and FIG. 6B.

According to one embodiment, the mechanical configuration and electrical control of the optical super-elevation device 220 allows maintaining, and even improving, the targeting accuracy of the weapon system 200. In part, this is accomplished by configuring the device as shown in FIG. 2 and FIG. 6A, such that the sighting unit 230 "looks through" the elevation follower mirror 300 during operation, and the elevation follower mirror 300 is counter-rotated with an opposite angular rate to the weapon elevation rate, as discussed above. This allows an operator to maintain "eyes on target" throughout the target engagement, while super-elevating the weapon and adjusting for range. In one example, the counter-rotation of the elevation follower mirror 300 is controlled by the electronic controller 350 using closed-loop feedback.

Figure 7:
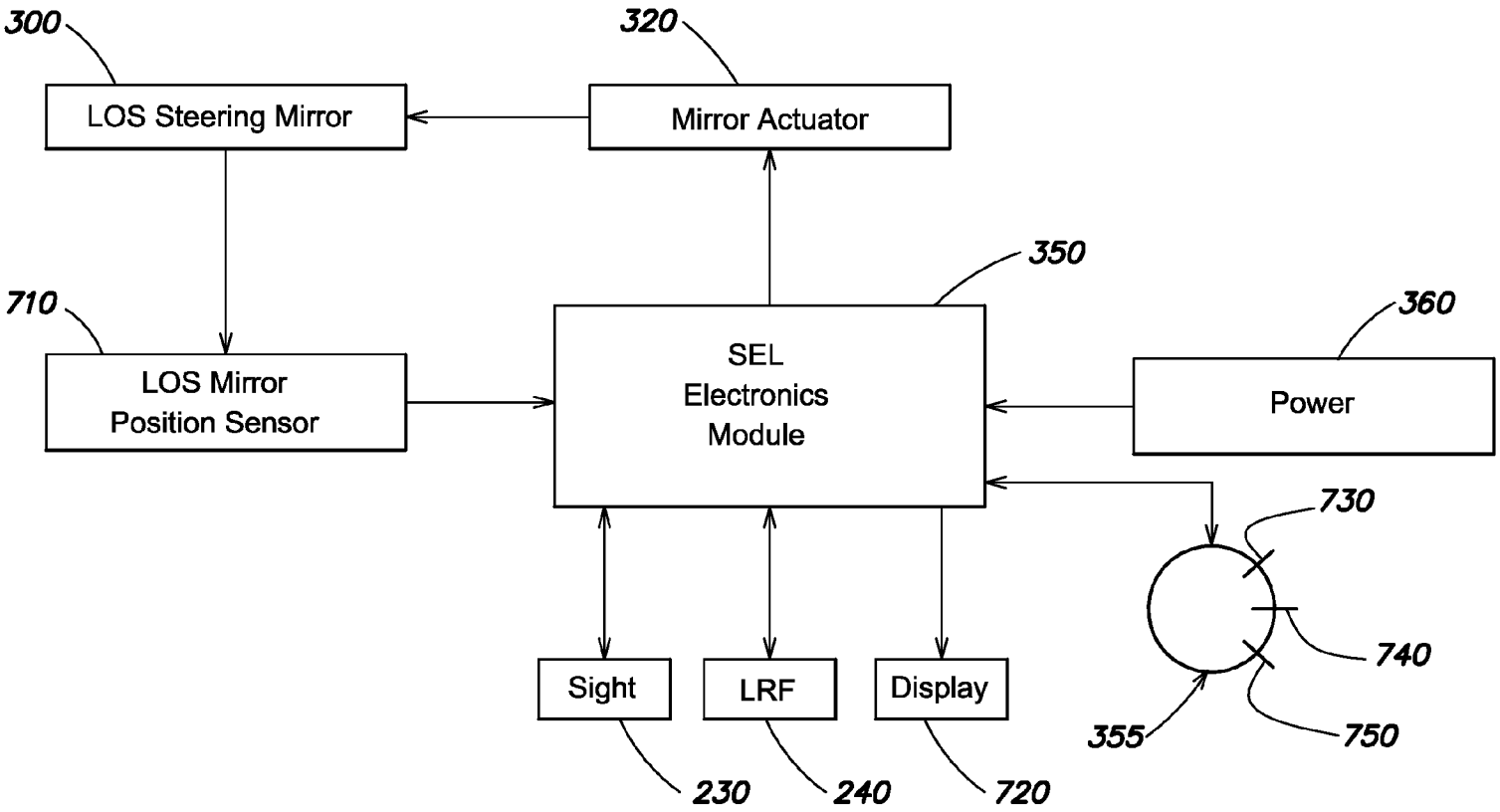
FIG. 7 is a block diagram of one example of a weapon system including an optical super-elevation device according aspects of the invention.

Referring to FIG. 7, in one embodiment, the electronics module or controller 350 controls the mirror actuator 320 to move the elevation follower mirror 300 to a selected angular position and thereby steer the line-of-sight. The mirror position is maintained by a software control loop in the controller 350. A mirror position sensor 710 collects and measures position information for the elevation follower mirror 300 and provides the position information to the controller 350, thereby forming a closed-loop control circuit. In one example, the position sensor 710 includes the mirror angle resolver 530 and optionally the motion sensor 535. Thus, the position sensor 710 may measure the pitch and cant of the weapon (using the motion sensor 535) and the rotation of the elevation follower mirror 300 (using the mirror angle resolver 530) and provide this information in real-time to the controller 350 to enable accurate line-of-sight control. In one example, the controller 350 is configured to determine the weapon elevation rate based on the information provided by the motion sensor 535, and thereby determine the appropriate angular rate of motion of the elevation follower mirror and control the mirror actuator 320 to counter-rotate the elevation follower mirror 300 at a rate opposite to the weapon elevation rate, as discussed above.

According to one embodiment, the controller 350 is interoperable with the weapon sighting unit 230 and/or laser range-finder 240, and may thus provide information to these systems and receive information and/or commands from these systems. In one example, the controller 350 may arbitrate communication between the laser range-finder 240 and the weapon sighting unit 230. In one embodiment, the weapon sighting system further includes a display 720 coupled to the controller 350, which may be a video display, for example. As discussed above, the optical super-elevation device 220 may include a control switch 355. In one example, the control switch 355 is a three-position switch, including an "off" position 730, and "on" position 740, and a "home" or "lock" position 750. This switch 355 allows an operator to turn on the super-elevation device and select a mode of operation of the device, as discussed further below.

Figure 8:
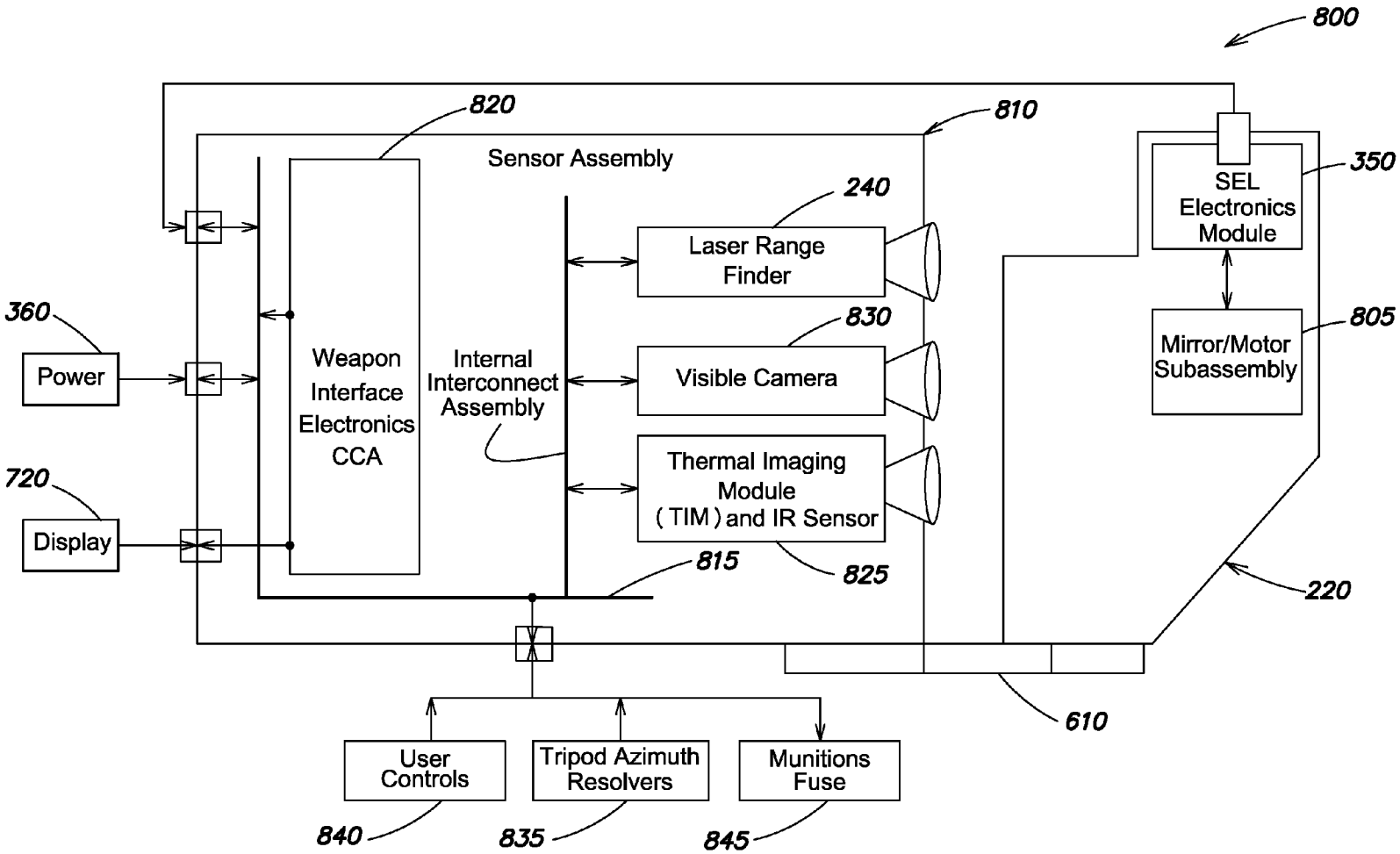
FIG. 8 is a block diagram of another example of a weapon system including an optical super-elevation device according to aspects of the invention.

Referring to FIG. 8, there is illustrated a block diagram of one example of a weapon system 800 including the optical super-elevation device 220. As discussed above, the optical super-elevation device 220 includes the controller 350 and a mirror/motor subassembly 805 including the elevation follower mirror 300, mirror actuator 320 and associated components. The controller 350 is in communication with a sensor assembly 810 of the weapon system via a communications bus 815. The sensor assembly 810 includes a control computer 820 that interfaces with, may obtain information from, and may supply control commands to, various components of the weapon system 800, including, for example, the laser range-finder 240 and display 720. In the illustrated example, the weapon system 800 includes a thermal imaging module 825 and a visible camera 830. One or both of these devices may be included in the weapon sighting unit 230 discussed above. In one example, for tripod-mounted weapons, the weapon position sensor 535 discussed above may include tripod azimuth resolvers 835. User controls 840 may represent various user control interfaces, such as buttons, switches, a trigger, etc., that allow an operator to use the weapon system 800. The munitions fuse 845 is coupled to the user controls 840 and control computer 820 an allows the weapon system 800 to fire a round of ammunition responsive to the user controls 840 when the weapon is in a safe firing mode as controlled by the control computer 820.

As discussed above, in one embodiment, the weapon sighting unit 230, such as a thermal weapon sight, is placed behind the optical super-elevation device 220 such that the line of sight to the target from the weapon sighting unit passes through the optical super-elevation device. In another embodiment, the visible camera 830 and/or laser range-finder 240 may also be located behind the optical super-elevation device 220 such that their lines of sight to the target also pass through the optical super-elevation device. In one such example, the front and rear windows 335 and 340 may be configured to pass a wide band of electromagnetic radiation to cover all bands used by the various devices. In another example, the front and rear windows 335 and 340 may include multiple regions, each region designed to be transparent at the operating spectral band of a particular component (e.g., infrared for the thermal weapon sighting unit and visible for the visible camera), with the regions being aligned with positions of the lines of sight from each component. Placing the laser range-finder behind the optical super-elevation device may allow the operator to re-range targets while maintaining super-elevation of the weapon to facilitate rapid fire at multiple targets or a moving target.

Figure 9:
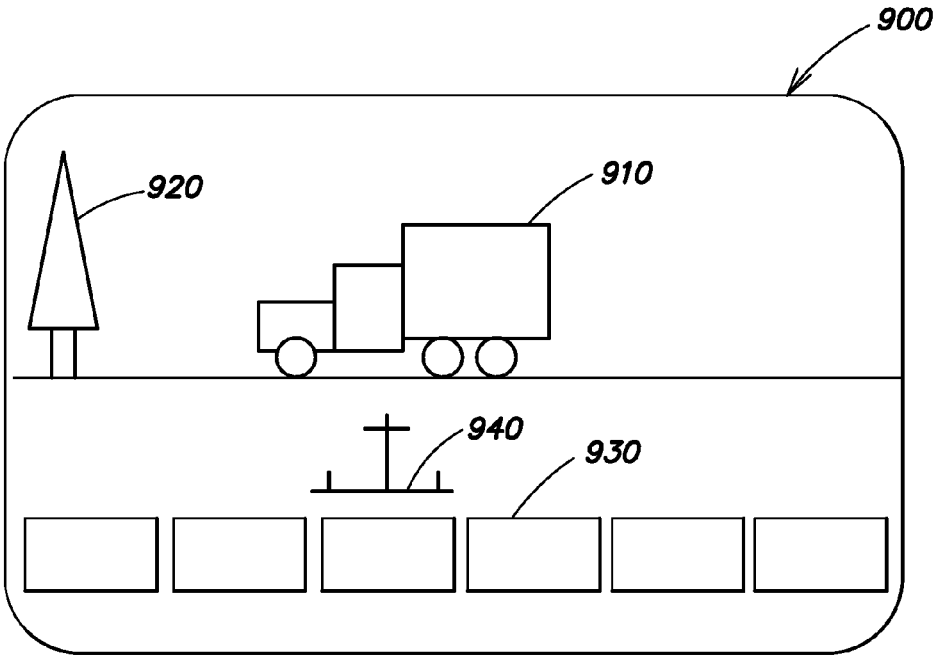
FIG. 9 is a schematic diagram of an example of an image showing an aiming reticule according to aspects of the invention.

According to one embodiment, to engage a target, a user of the weapon system 800 switches the control switch 355 to turn on the optical super-elevation device, and moves the weapon body in azimuth and elevation, for example using handles 214 (see FIG. 2), to acquire a target. FIG. 9 illustrates an example of an image 900 of a scene including a target 910 and various other objects 920, as may be viewed by an operator on the display 720. Various other information, such as range to the target, status and/or operating mode of various weapon components, pointing angle of the weapon, etc. may also be displayed in the image 900, as represented by blocks 930.

In one example, the operator moves the weapon in azimuth and elevation until an aiming reticle 940 is centered on the target 910. The operator may then use the laser range-finder 240 to obtain a measurement of the range to the target. Using this information, the weapon sighting unit 230 may calculate the ballistic solution, including the amount of super-elevation required. The weapon sighting unit 230 may receive a current line of sight offset value from the controller 350 (which may obtain this offset value based on the angular position of the mirror 300 received from the mirror angle resolver 530), and use this offset value to provide a control signal to the control computer 820 to displace the aiming reticule 940 downwards from the target 910, as illustrated in FIG. 9. Downward displacement of the aiming reticle 940 signals to the operator that super-elevation of the weapon is required. The operator may then pivot the weapon to move the aiming reticule 940 upwards until it is again centered on the target 910. As discussed above, because the weapon sighting unit 230 may be located behind the optical super-elevation device 220 (and along the line of sight to the target), the operator may complete these tasks while maintaining the target in sight through the weapon sighting unit 230. In one example, if the amount of super-elevation is large enough for the offset to displace the aiming reticle 940 beyond the boundary of the field of view of display 720, the control computer 820 does not move the aiming reticle 940 off the display screen, but rather moves the aiming reticle until it is adjacent an edge of the display and hence still visible. In doing so, the control computer 820 may apply only a portion of the super-elevation offset to the aiming reticle 940, and stores the balance of the offset in memory. To ensure that the operator is aware that the aiming reticule 940 is temporarily not tracking the movement of the weapon barrel 212, the control computer 820 may change the appearance of the aiming reticule in the image 900 (for example, by changing the color, making the reticle blink, or displaying only a portion of the reticle).

According to one embodiment, to achieve the pointing accuracy within the optical super-elevation assembly 220, the controller 350 may automatically lock the elevation follower mirror 300 to the weapon once the operator switches the control switch 355 into the on position 740. This allows the operator to fine-adjust the weapon aiming reticule 940 to the disturbed reticule ballistic firing solution while meeting associated ballistic error performance requirements. In one example, the control switch 355 may be operated to place the optical super-elevation device 220 in the lock position 750 during the ranging operation. In the lock position 750, the elevation follower mirror 300 may be placed in a "home" position, which may be a boresight position measured and stored in the controller 350 memory during initial set-up of the device (for example, factory calibration of the device and/or associated weapon). In this example, the offset value supplied to the weapon sighting system 230 may be read by the controller 350 from the mirror angle resolver 530, or may be a preset value corresponding to the predetermined boresight position of the elevation follower mirror 300. After the ranging operation, the control switch 355 may be turned to the on position 740, to allow the operator to perform the super-elevation and target acquisition processes discussed above. In the on position 740, the software control loop in the controller 350 discussed above may be used to track weapon elevation angle changes, control the position of the elevation follower mirror 300 via the mirror actuator 320, and maintain the mirror position by monitoring the mirror angle resolver 530, as discussed above.

Figure 10:
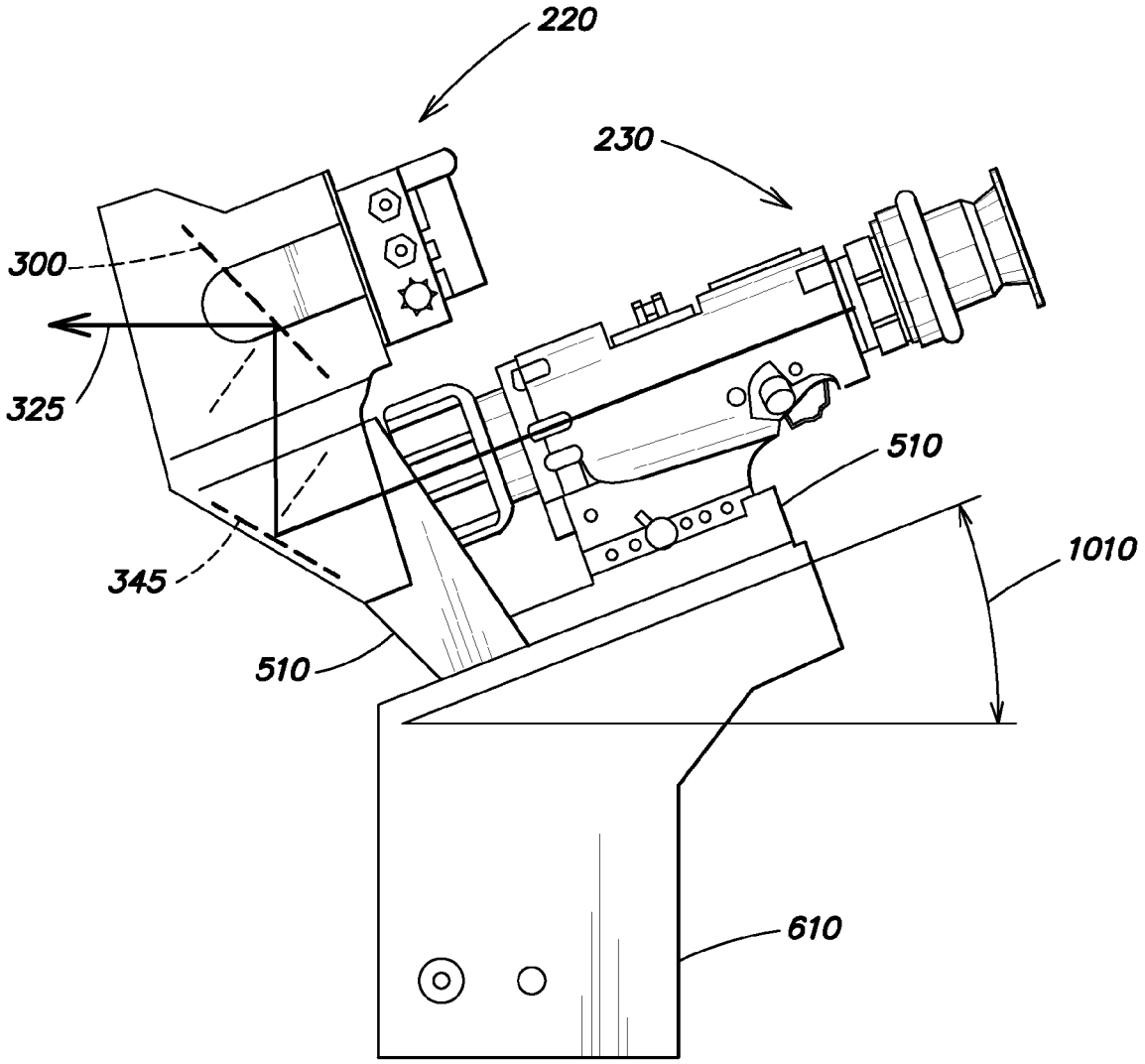
FIG. 10 is a side view of another example of a weapon sighting system including an optical super-elevation device according to aspects of the invention.

As discussed above, in some instances, the range of super-elevation offset angles may be relatively large, for example, approximately 0-40 degrees for some long-range heavy machine guns. The mounting configuration of the elevation follower mirror 300 and mirror actuator 320 may accommodate these elevation ranges. In addition, the mirror actuator 320 and software control loop in the controller 350 may be configured to achieve responsiveness (movement of the elevation follower mirror 300 and display of the aiming reticule) of approximately 60 degrees/second. These abilities, coupled with the aiming accuracy of the weapon sight unit 230, may facilitate rapid targeting from about 40 to 2,000 meters, with greatly improved affordability over mechanical or electro-mechanical designs. However, in some examples it may be desirable to decrease the elevation range that the optical super-elevation device 220 may need to cover, for example, to improve targeting speed and/or to minimize the size of the optical super-elevation assembly and associated optical signature. Accordingly, referring to FIG. 10, in one embodiment, the mounting brackets 510 and/or 610 may be configured such that that the optical super-elevation device 220 is mounted to the weapon with a built-in "pre-tilt" elevation angle 1010. This pre-tilt angle 1010 may be selected, for example, based on known characteristics of the weapon or its expected use (e.g., the type of rounds fired and typical engagement ranges, which determine expected ballistic solutions). In one example, for a grenade-launching machine gun, the pre-tilt angle 1010 may be about 20 degrees.

Thus, aspects and embodiments may provide an optical super-elevation device that offers numerous advantages over conventional mechanical or electro-mechanical devices. For example, as discussed above, embodiments of the optical super-elevation device allow the weapon operator to maintain the target in the weapon sight field-of-view at all times during engagement such that the operator does not have to reacquire the target after super-elevating the weapon. In addition, as discussed above, embodiments of the optical super-elevation device offer a low-cost and lower SWAP (size, weight and power) solution compared to conventional mechanical or electro-mechanical devices since the moving parts may include only a relatively small, light-weight elevation follower mirror and its associated actuator. Furthermore, the modular configuration of the optical super-elevation device, contained with the housing 305, facilitates easy application to a wide variety of different weapon systems. Embodiments of the optical super-elevation device used together with the weapon sighting unit, as discussed above, may increase first round accuracy, reduce engagement time, and allow greater confidence in engaging targets at longer range.

Having described above several aspects of at least one embodiment, it is to be appreciated various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only, and the scope of the invention should be determined from proper construction of the appended claims, and their equivalents.

What is claimed is:

1. An optical super-elevation device comprising:

a modular housing including a first mounting bracket configured to fixedly mount to at least one of a weapon and an azimuth axis of a tripod configured to support the weapon;

an elevation follower mirror rotatably mounted within the housing; and a mirror actuator coupled to the elevation follower mirror and configured to counter-rotate the elevation follower mirror at an angular rate opposite to an elevation rate of the weapon to maintain a line of sight to a target during super-elevation of the weapon above the line of sight.

2. The optical super-elevation device of claim 1, further comprising:

a position sensor that provides mirror position information and weapon position information; and a controller coupled to the position sensor and to the mirror actuator, the controller configured to receive the mirror position information and the weapon position information from the position sensor and to control the mirror actuator to control the angular rate of the elevation follower mirror based on the mirror position information and the weapon position information.

3. The optical super-elevation device of claim 2, wherein the position sensor includes:

a mirror angle resolver coupled to the elevation follower mirror and configured to provide the mirror position information, the mirror position information including an angular position of the elevation follower mirror;

a motion sensor coupled to the weapon and configured to provide the weapon position and angle position rate information; and an azimuth position sensor coupled to the weapon and configured to provide weapon azimuth position information.

4. The optical super-elevation device of claim 3, wherein the weapon position information includes weapon cant and elevation information, and wherein the controller is configured to determine the weapon elevation rate based on the weapon cant and elevation information.

5. The optical super-elevation device of claim 1, further comprising:

a front window disposed within the housing; and a rear window disposed within the housing, the elevation follower mirror arranged within the housing such that the line of sight to the target sequentially passes through the rear window, is deflected by the elevation follower, and passes through the front window.

6. The optical super-elevation device of claim 5, further comprising a fold mirror disposed within the housing and positioned in the line-of-sight to the target between the rear window and the elevation follower mirror.

7. The optical super-elevation device of claim 6, further comprising a second mounting bracket coupled to the housing and configured to receive and mount a weapon sighting unit behind the rear window and to receive and mount a laser range finding unit.

8. The optical super-elevation device of claim 5, wherein the front and rear windows are multi-spectral windows configured to pass at least one of infrared electromagnetic radiation and visible light.

9. The optical super-elevation device of claim 1, further comprising a battery pack coupled to the housing and configured to provide all operating power to the mirror actuator.

10. A weapon sighting system configured to be mounted to a weapon and comprising:

a mounting bracket configured to fixedly mount to at least one of the weapon and an azimuth axis of a tripod configured to support the weapon, the mounting bracket including a rail assembly;

an optical super-elevation device including a housing attached to the mounting bracket, an elevation follower mirror rotatably mounted within the housing, and a mirror actuator coupled to the elevation follower mirror and configured to counter-rotate the elevation follower mirror; and a weapon sighting unit mounted to the rail assembly and positioned with respect to the optical super-elevation device such that a line-of-sight of the weapon sighting unit to a target passes through the optical super-elevation device and is steered by the elevation follower mirror;

wherein through the fixed mounting of the mounting bracket to the at least one of the weapon and the azimuth axis of the tripod, during elevation of the weapon the optical super-elevation device and the weapon sighting unit move simultaneously in elevation with the weapon, and wherein the mirror actuator is configured to counter-rotate the elevation follower mirror at an angular rate opposite to an elevation rate of the weapon to maintain the line-of-sight to the target during super-elevation of the weapon above the line-of-sight.

11. The weapon sighting system of claim 10, wherein the weapon sighting unit includes at least one of a thermal imaging system, a visible imaging sensor and an infrared imaging sensor.

12. The weapon sighting system of claim 10, further comprising a laser range-finder coupled to the weapon sighting unit.

13. The weapon sighting system of claim 12, wherein the laser range-finder is mounted such that a line-of-sight from the laser range-finder to the target passes through the optical super-elevation device.

14. The weapon sighting system of claim 10, further comprising:

a position sensor coupled to the elevation follower mirror; and a controller coupled to the mirror actuator and to the position sensor and configured to control the angular rate of counter-rotation of the elevation follower mirror based on information received from the position sensor.

15. The weapon sighting system of claim 14, wherein the position sensor includes:

a mirror angle resolver coupled to the elevation follower mirror and configured to provide mirror position information, the mirror position information including an angular position of the elevation follower mirror; and a motion sensor coupled to the weapon and configured to provide weapon cant and elevation position information, the controller being configured to control the angular rate of counter-rotation the elevation follower mirror based on the mirror position information and the weapon cant and elevation information.

* * * * *